US006390401B1

(12) United States Patent
Sellars

(10) Patent No.: US 6,390,401 B1
(45) **Date of Patent: *May 21, 2002**

(54) LINER SEGMENT LOCATOR/RETAINER FOR ORE GRINDING MILLS

(75) Inventor: John Francis Sellars, Andover, MN (US)

(73) Assignee: Servicios Y Consultorias Hendaya S.A., Santiago (CL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/376,813

(22) Filed: Aug. 18, 1999

(51) Int. Cl.[7] ..... B02C 17/22
(52) U.S. Cl. ..... 241/299; 241/300
(58) Field of Search ..... 241/298, 294, 241/300, 182, 183, 299, DIG. 30

(56) References Cited

U.S. PATENT DOCUMENTS 4,018,393 A * 4/1977 Larsen ..... 241/182
5,060,875 A * 10/1991 McBride ..... 241/294

* cited by examiner

*Primary Examiner*—Mark Rosenbaum
(74) *Attorney, Agent, or Firm*—Merchant & Gould PC

(57) ABSTRACT

A liner assembly for the discharge end of an ore comminuting mill is disclosed. The discharge end is defined by an end wall having a plurality of bolt holes formed therethrough in a predetermined pattern for attaching the liner segments to the inner surface of the end wall. Each liner segment is formed with a plurality of bolt holes capable of being aligned with the bolt holes in the end wall. A locator pin projecting from the mounting surface of the liner segment is sized and configured to project into one of the end wall bolt holes, and it is positioned relative to the bolt holes in the liner segment so that upon such insertion the bolt holes of the liner segment automatically align with those of the end wall.

6 Claims, 4 Drawing Sheets

LINER SEGMENT LOCATOR/RETAINER FOR ORE GRINDING MILLS

The invention broadly relates to ore grinding machines and is specifically directed to an improved segmented liner assembly and the individual segments for the discharged end of an ore grinding machine.

Ore grinding machines are commonly used as one step in the process of reducing the size of ore in commercial mining operations. One type of ore grinding machine consists of a large cylindrical drum mounted on bearings for rotation about a substantially horizontal axis and driven by a powerful motor through conventional reduction gearing. The cylindrical drum may be of differing diameters depending on the needs of the operation and may reach diameters of 40 feet.

The ends of the drum are substantially closed but respectively define an axial inlet opening and an axial discharge opening. The ore which is to be ground or comminuted is continuously fed into the mill at the inlet end with the product of reduced size continuously emerging from the discharge end.

It is conventional to line the cylindrical drum with liner segments of different configuration and different metallurgical hardness to enable the ore to be comminuted as efficiently as possible while minimizing the wear rate of the individual segments. Commercial mining operations typically operate 24 hours a day, and down time to remove a worn set of liner segments and replace them with new segments is a time consuming process.

The discharge end of the cylindrical drum is typically conical in shape and includes one or more sets of end liner segments that are arranged in a radial pattern relative to the axial discharge opening. In larger mills there may be two or three sets of discharge end segment assemblies which are arranged concentrically relative to the axial discharge opening, with the segments of one assembly aligned radially with the segments of a contiguous assembly.

It is also common to cast the individual segments of the discharge end in a hollow manner so that each defines a large radial trough. With the radial channels of contiguous concentric assemblies aligned radially, comminuted ore may enter the radially extending channels of the discharge end liner assembly and be centrifugally forced radially inward toward and out of the discharge outlet.

As suggested above, the replacement of liner assemblies in the cylindrical drum of an ore grinding machine is a difficult and time consuming task. Each of the individual segments may weight several thousand pounds, and it must be placed in its proper position for mounting. The mounting of liner segments is typically accomplished a plurality of bolts for each segment that extend trough bolt holes in the segment itself and aligned bolt holes in the cylindrical drum. Proper alignment must occur before the bolts can be inserted and fastened.

The problem is even more difficult with regard to the liner segments in the discharge end of the cylindrical drum, particularly where two or three concentric assemblies are mounted. Conventionally, the outermost assembly is installed first followed by the next concentric assembly the individual segments of which may rest on the now installed first assembly. However, it is quite difficult to properly locate the individual segments of the outermost concentric assembly, which is the first step in the process.

Another problem arises with the liner segments in the discharge end of the cylindrical drum. Conventionally, the comminuted ore fragments are allowed to be discharged only after they have been reduced to a predetermined size. This is accomplished with a large grate that forms part of the discharge end of the mill. The grate has openings of a predetermined size, and the ore can be discharged only if it is small enough to pass through these grate openings.

The problem arises from the fact that clearance is designed between the segment mounting bolts and the bolt holes in the liner segment and/or the aligned bolt holes in the cylindrical drum. Clearance is also necessarily designed between the sides of each segment and its adjacent segments. This bolt hole and side-to-side clearance facilitates installation of the liner segments due to their extreme size and weight. In other words, without the clearance it would be extremely difficult to precisely place the segment to gain alignment of the bolt holes while at the same time squeezing the segment end relative to its adjacent segments.

While these clearances facilitate installation, they also create a problem because the segments on the discharge end tend to migrate radially outward due to centrifugal forces created as the drum rotates. As a result, all of the gaps that normally exist between adjacent segments accumulate in a single gap that may itself be larger than the grate opening that sizes the ore fragments. As a consequence, oversized fragments may be discharged from the mill.

This invention is directed to a unique locating device for the discharge and liner assembly, and particularly for the outermost concentric liner assembly of the ore grinding machine. The locating device in the preferred embodiment comprises a pin or boss that is cast on the backside of each liner segment (i.e., the side which faces and mates with the discharge end of the cylindrical drum), and which is disposed to fit into an existing bolt hole in the cylindrical drum. This advantageously makes use of the existing bolt holes in the cylindrical drum without requiring modification.

During installation, the individual segments having locator pins are placed with the locator pin projecting into the locator opening, which effectively aligns all of the bolt holes of a segment with the bolt holes in the cylindrical drum. This saves considerable time and effort in installing these end segments.

Once the outermost concentric liner assembly is installed on the discharge end of the cylindrical drum, the individual segments of the contiguous liner assembly can be mounted. Locator pins may also be used for this purpose, although it is conventional for the contiguous segment to be configured in such a manner that it mates with and becomes radially aligned with the previously mounted segment, thus establishing alignment of the radial troughs through which the comminuted ore passes. If a third concentric assembly is used, it is similarly constructed and mounted in the same manner.

The use of this simple locating device makes the installation procedure much easier for the workmen installing the liner assembly, saving significant time in the installation procedure and thus reducing the down time of the mill. The locating device also serves to retain the liner segments in the initial installation position, thus preventing outward migration due to centrifugal force. This in turn avoids oversize fragments being discharged from the mill.

The specific structure and features of the invention will be more fully appreciated from the specification and drawings.

DETAILED DESCRIPTION OF THE PREFERRED EMBODIMENT

Figure 1:
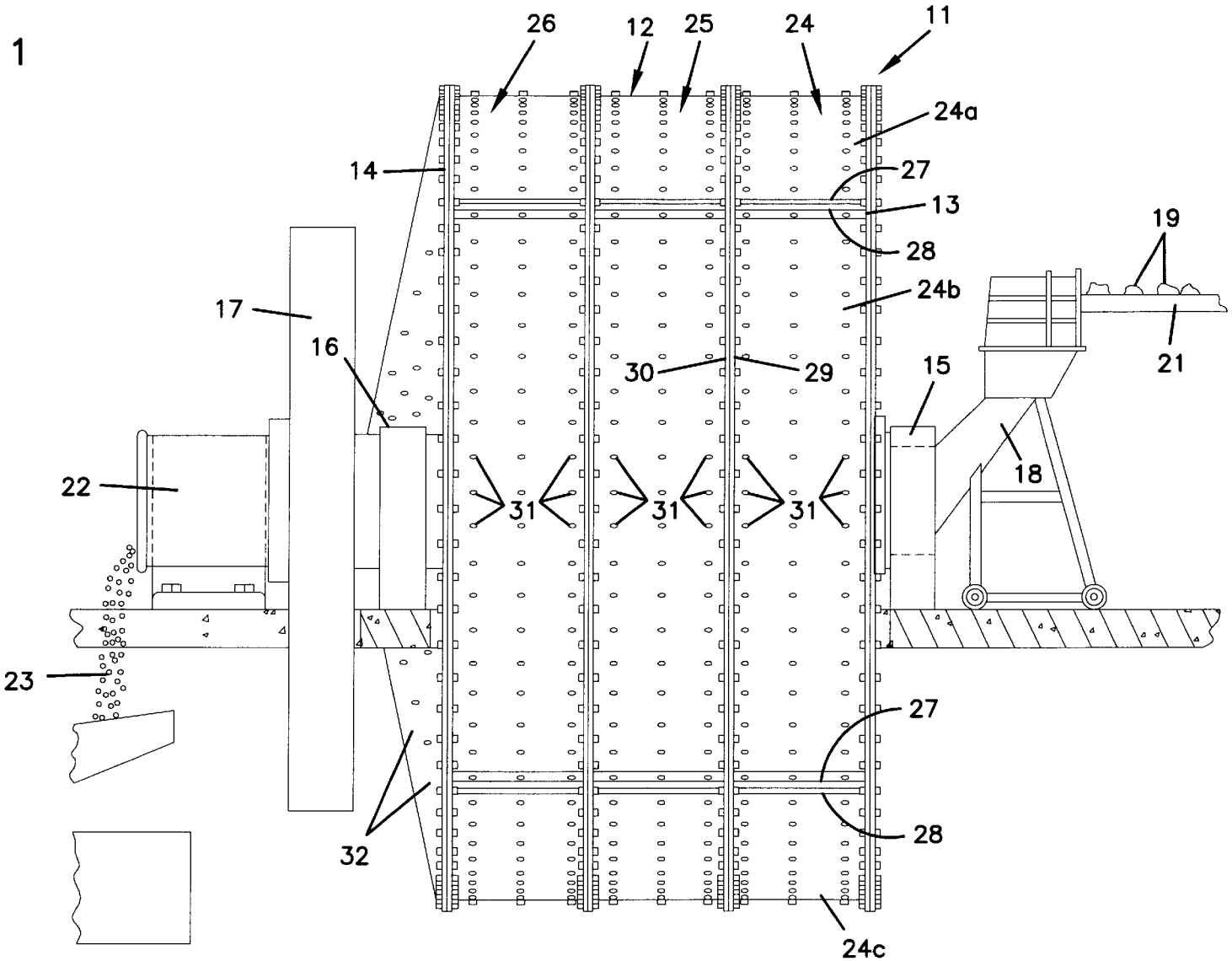
FIG. 1 is a side elevational view of an ore grinding mill for reducing the size of ore fragments and which utilizes the inventive segmented liner assembly for the mill discharge end.

With initial reference to FIG. 1, an ore grinding mill employing the inventive liner assembly is referred to generally by the numeral 11. Mill 11 includes a hollow cylindrical drum or shell 12 having an inlet end 13 and an outlet end 14. End wall 13 is formed with a large axially disposed inlet opening (not shown). End wall 14 is also formed within a large axially disposed discharge opening 14*a* (see FIGS. 3 and 4).

The cylindrical drum 12 is arranged for rotation about a substantially horizontal axis in suitable bearings 15, 16 by a drive of conventional construction in a housing 17. A chute 18 communicating with the axial inlet receives ore fragments 19 from a conveyor 21. The comminuted material leaves the drum 12 through the discharge opening 14*a* and is discharged from mill 11 through an outlet 22.

Cylindrical drum 12 is made up of a plurality of cylindrical sections 24–26 each of which is in turn assembled from a set of cylindrical quadrants by bolts extending through axial flanges. For example, section 24 consists of quadrants 24*a*, 24*c* (one quadrant is not shown) which are secured together circumferentially by a plurality of bolts passing through radially extending, axially aligned flanges 27, 28. The cylindrical sections 24, 25 are secured together axially by a plurality of bolts passing through circumferential flanges 29, 30 extending radially from the periphery of each side. Cylindrical sections 25, 26 are secured in an identical manner, as are the end walls 13, 14 to the cylindrical sections 24, 26, respectively.

Each of the cylindrical sections 24–26 of drum 12 is formed with a plurality of liner mounting bolt holes 31 which are positioned in a pattern defining axially rows, the rows being spaced equiangularly about the drum, and in circumferential rows which are equidistantly spaced within each of the sections 24–26. End wall 14 also includes a plurality of bolt holes 29 which extend radially outward from discharge opening 14*a* and also lie in concentric circles.

The inner circumferential surface of drum 12 is conventionally formed with a plurality of liner segments 32 of predetermined configuration (see FIGS. 4 and 5) which include axially extending lifter bars for lifting ore fragments upward as the drum 12 rotates. At a predetermined point the ore fragments drop from the lifter bars and tumble onto the ore charge at the bottom of the cylindrical drum, impacting the ore fragments in the charge and thus comminuting the ore. The comminution may be assisted by including steel balls or rods to the ore charge.

The inner frustroconical surface of end wall 14 is also covered with liner segments, Because of the substantial diameter of drum 12, the liner segments are formed into three concentric liner assemblies each of which is defined by a plurality of liner segments as discussed below.

Figure 2:
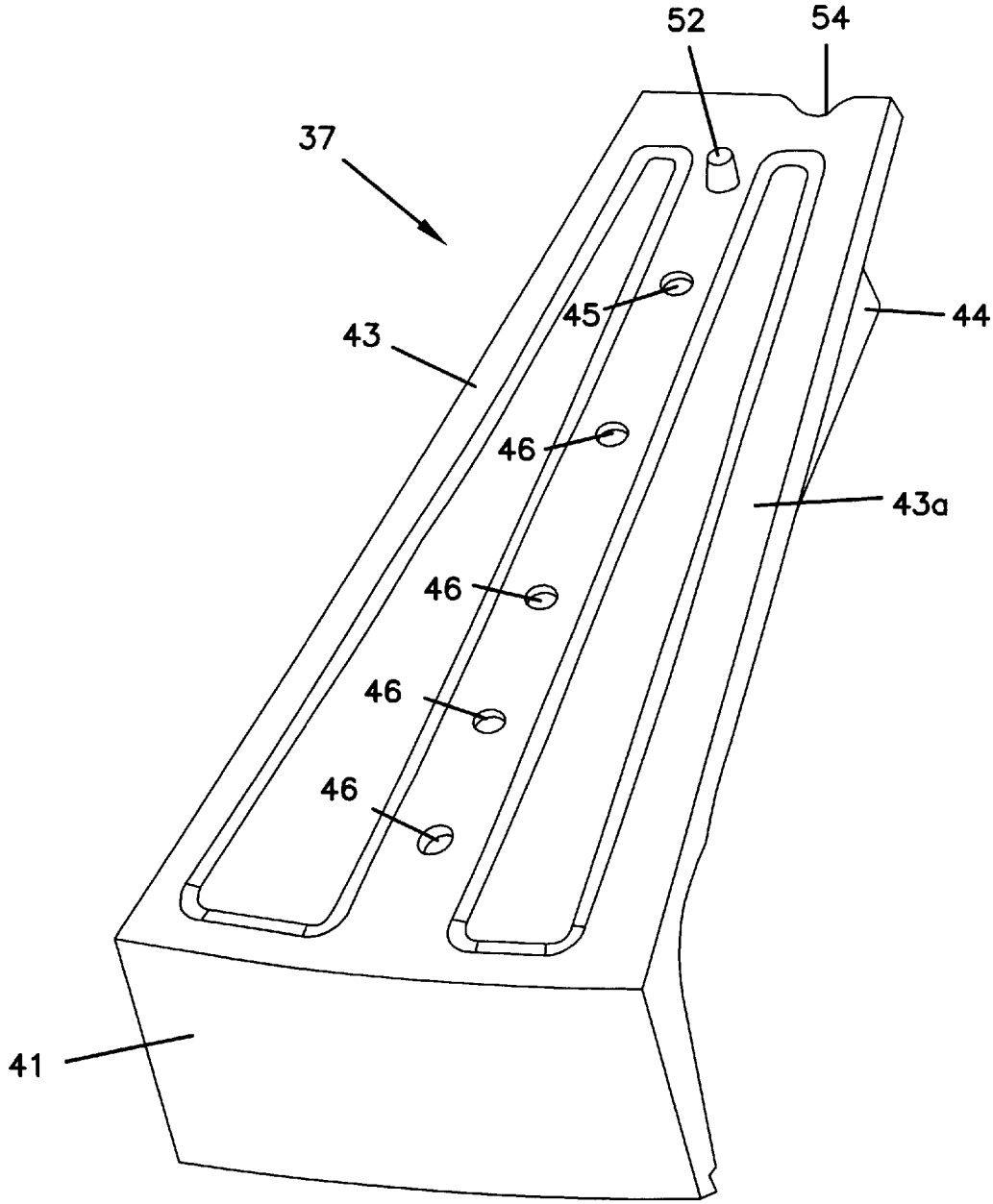
FIG. 2 is an enlarged perspective view of a liner segment for the discharge end of the ore grinding mill.
Figure 3:
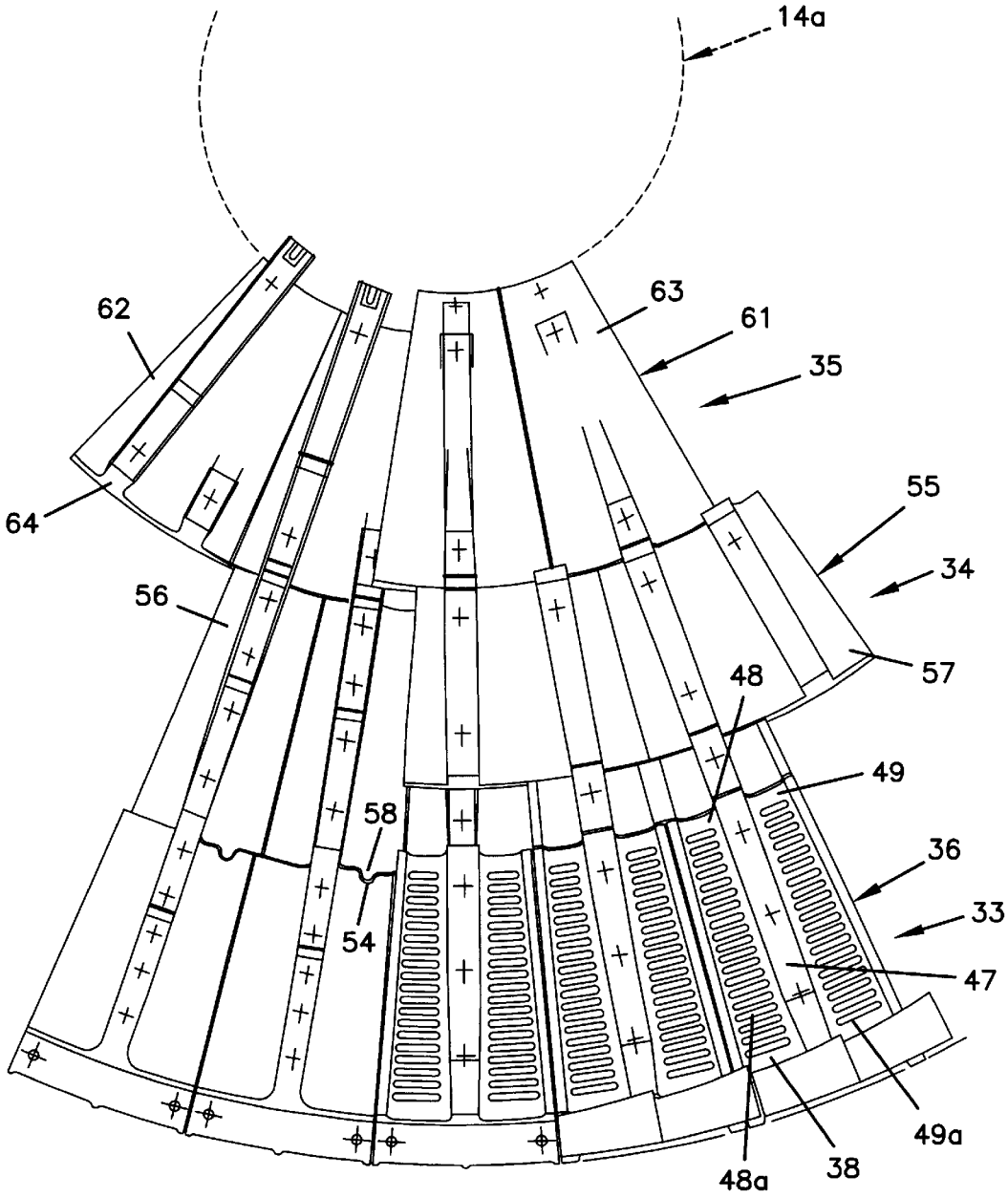
FIG. 3 is a fragmentary side elevational view of a portion of the segment liner assembly for the discharge end of the ore grinding mill.
Figure 4:
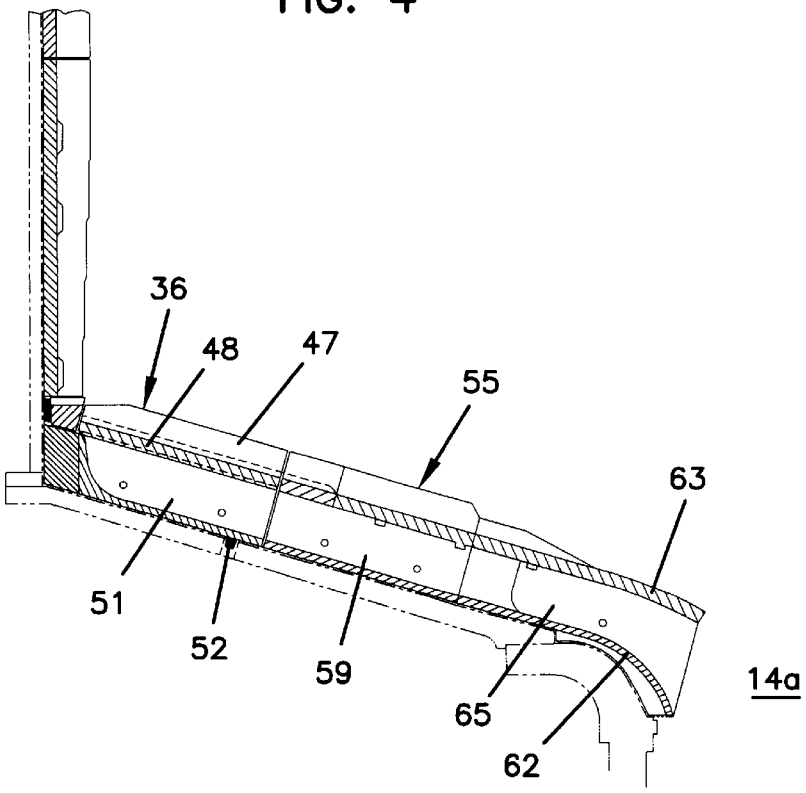
FIG. 4 is an enlarged fragmentary sectional view taken along the line 4—4 of FIG. 3.
Figure 5:
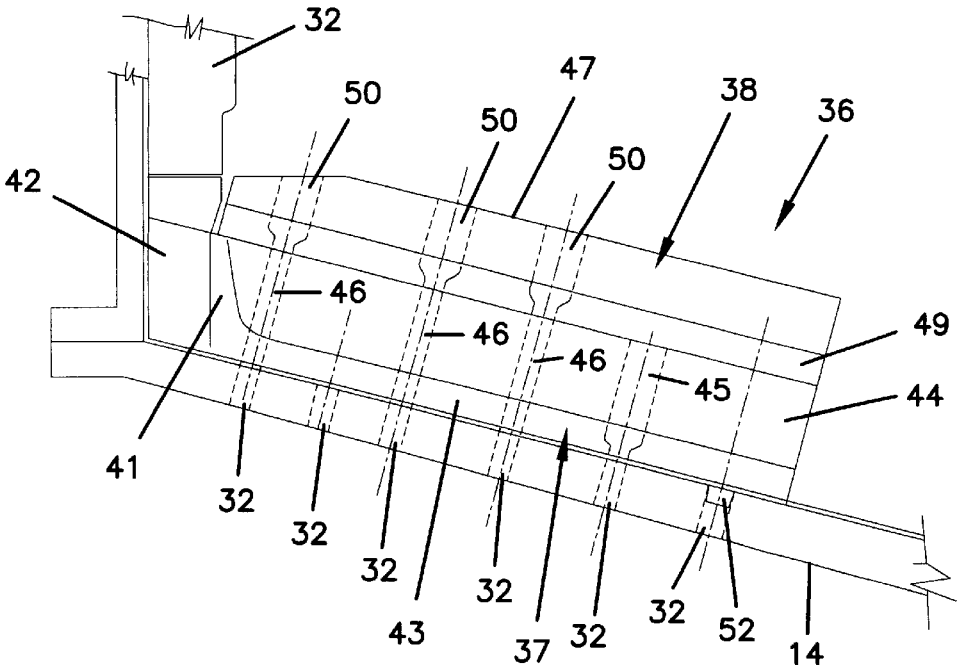
FIG. 5 is a further enlarged fragmentary sectional view taken along the line 5—5 of FIG. 3.

With reference to FIGS. 2–5, the outer most concentric liner assembly 33 is made up of a plurality of individual liner segments 36 which are mounted to the end wall 14 in a radial pattern. As best shown in FIGS. 4 and 5, each of the liner segments 56 is formed by inner and outer segments 37, 38. Inner segment, which is shown in the perspective view of FIG. 2, is formed with a foot portion 41 that rests on a filler block 42 mounted on the inner cylindrical surface of drum 12 at its junction with end wall 14. Projecting angularly upwardly from the foot portion 41 is a primary or back member 43 that defines a substantially planar mounting surface 43*a*. Surface 43*a* mates with the inner conical surface of end wall 14. Projecting perpendicularly from the front face of the back member 43 is an elongated central rib 44. As best shown in FIG. 5, a tapered bolt hole 45 is formed through the rib 44 at an upper (or radially inward) position on the rib 44, and untapered bolt holes 46 are formed in spaced relation therebelow. The bolt holes 45, 46 are disposed in the rib 44 so that they can be aligned with the bolt holes 32 in the end wall 14 for installation.

With reference to FIGS. 3–5, outer segment 38 overlies the entirety of inner segment 37 and is mounted on top of rib 44. It also comprises a wider elongated rib 47 which is shaped to receive and fit over the rib 44. Tapered bolt holes 50 are formed through the rib 47 in registration with the untapered bolt holes 46 in rib 44. Grated side members 48, 49 project laterally from the rib 47 and are spaced from and in substantially parallel relation to the back member 43 of inner segment 47. As such, and as best shown in FIGS. 4 and 5, outlet channels 51 are defined on each side of the rib 44 between the members 43, 48 and 49. Each of the side members 48, 49 is formed with a plurality of grate openings 48*a*, 49*a* which permit the entry of comminuted ore fragments that have been reduced or comminuted to a size less than the width of the openings 48*a*, 49*a*.

With reference to FIGS. 2, 4 and 5, a locator pin 52 projects from the mounting surface 43*a* of back member 43 in linear alignment with the bolt holes 45, 46. In the preferred embodiment, locator pin 52 is circular in cross section and tapers slightly from its base to its extreme end.

With specific reference to FIGS. 4 and 5 locator pin 52 projects into one of the bolt holes 32 in the wall 14, and it is positioned so that when it enters the bolt hole 32 and foot portion 41 rests on filler 42, the bolt holes 45, 46 of segment 36 are inherently aligned with the bolt holes 32 in end wall 14. When in this position, tapered head bolts (not shown) such as those disclosed in U.S. Pat. No. 4,018,393 may be used to mount the inner and outer segments 37, 38 to the end wall 14.

As will be appreciated from FIG. 5, in the installation of the liner assembly 36 the inner segment 37 is first mounted to end wall 14 by placing the segment in a position where locator pin 52 projects into its associated bolt hole 32. At this point in time a tapered head bolt may be inserted into the bolt hole 45 and a nut screwed on to the projecting bolt on the outer surface of end wall 14. Thereafter, the outer segment 38 may be placed over the inner segment 37 and tapered head bolts inserted into the bolt holes 50, extending through the bolt holes 46 and projecting externally of the end wall 14 where they receive a mounting nut.

With reference to FIGS. 2 and 3, a dip or recess 54 is formed in the upper edge of back member 43. This serves as a locator for the individual segments 55 of liner assembly 34. As shown in FIG. 3, each of these liner segments 55 is also formed from inner and outer segments 56, 57. As shown in FIG. 3, the lower edge of inner segment 56 is formed with a projection 58 that fits into the recess 54 of the inner segment 37 immediately below. This serves to locate the inner segment 56 so that its bolt holes are aligned with bolt holes in end wall 14.

As best shown in FIG. 4, the liner segments 55 also define radial discharge channels 59 that are disposed in registration with the discharge channels 51.

Similarly, the inner most concentric liner assembly 35 comprises a plurality of liner segments 61 each of which is formed from an inner segment 62 and an outer segment 63. The inner segment 62 is formed with a rectangular recess 64 that fits over the radially projecting central rib of the associated inner segment 56 of concentric liner assembly 34. This serves to locate each of the segments 61 in a proper position relative to the underlying segments 56. The outer segment 63 fits over the inner segment 62, and as best shown in FIG. 4 defines a discharge channel 65 disposed and registration with the discharged channels 59, 65. The outlet of discharged channels 65 empty into the discharge outlet 14*a* of the mill 11.

In operation, and with particular reference to FIG. 4, a substantial portion of the ore charge rests at the bottom of cylindrical drum 12 as it rotates. As indicated above, ore fragments from the charge are carried upward the lifter bars of the liner assembly as the drum 12 rotates until gravity causes them to drop onto the main ore charge resulting in comminution of the ore fragments. When the ore fragments are reduced to a size less than the grate openings 48*a*, these fragments pass through the grate 48 and into discharge channel 51. Because discharge channels 51, 59 and 65 follow the angular direction of conical end wall 14, the reduced ore fragments pass upward through the discharge channels by centrifugal force, leaving the ore mill 11 through the discharge opening 14*a*.

It will be appreciated that the locator pin 52 on each of the inner segments 37 of the concentric liner assembly 33 enables the segment to be quickly and easily located in its proper position, resulting in automatic alignment of the bolt holes 45, 46 and 50 with the associated bolt holes 32 and end wall 14. Once the liner segments 36 are bolted in place, the concentric liner assemblies 34, 35 may also be quickly and easily placed and bolted to the end wall 14, saving considerable time in the installation of the liner assemblies and reducing down time of the mill 11.

The locator pins 52 also prevent radially outward migration of the liner segments 37, thus avoid the problem of oversized fragments from being discharged from the mill 11.

The above specification, examples and data provide a complete description of the manufacture and use of the composition of the invention. Since many embodiments of these invention can be made without departing from the spirit and scope of the invention, the invention resides in the claims hereinafter appended.

I claim:

1. An ore comminuting mill comprising a cylindrical shell that rotates about a predetermined axis of rotation, the shell comprising a discharge end that is substantially closed and defines an axial outlet through which comminuted ore is discharged, the mill further comprising a segmented liner assembly for the discharge end, comprising a plurality of individual liner segments removeably connected to the discharge end through a plurality of aligned bolt holes respectively formed through the cylindrical shell and each liner segment, said bolt holes being arranged in a predetermined pattern, said liner segments being disposed to cover and protect said discharge end, wherein the plurality of liner segments are fixed radially about a circumference of the discharge end, wherein one of the liner segments being an inner liner segment and another one of the liner segments being an outer liner segment, the inner liner segment comprising a locator pin projecting from a mounting surface towards the discharge end and engaged to the discharge end, wherein the locator member prevents radial movement of the liner assembly.

2. An ore comminuting mill according to claim 1, wherein the outer segment includes a protruding member that projects towards a recess of a liner segment in the liner assembly when the outer segment is fitted with the liner assembly.

3. An ore comminuting mill according to claim 1, wherein the locator pin being sized for insertion into one of the bolt holes in said discharge end and disposed so that, upon insertion, the segments can be positioned with its bolt holes aligned in registration with the holes with said discharge end.

4. An ore comminuting mill comprising a cylindrical shell that rotates about a predetermined axis of rotation, the shell comprising a discharge end that is substantially closed and defines an axial outlet through which comminuted ore is discharged, the mill furthers comprising a segmented liner assembly for the discharge end, comprising an inner liner segment and an outer liner segment removeably connected to the discharge end through a plurality of aligned bolt holes respectively formed through the cylindrical shell and each liner segment, said bolt holes being arranged in a predetermined pattern, said inner and outer liner segments being disposed to cover and protect said discharge end, wherein said inner and outer liner segments are fixed radially about a circumference of the discharge end, and wherein the inner liner segment comprising a locator pin projecting from a mounting surface towards the discharge end and engaged to the discharge end, wherein the locator member prevents radial and circumferential movement of the liner assembly.

5. An ore comminuting mill according to claim 4, wherein the inner liner segment comprises a recess and the outer segment includes a protruding member that projects towards the inner segment when the outer segment is fitted over the inner segment.

6. An ore comminuting mill according to claim 4, wherein the locator pin being sized for insertion into one of the bolt holes in said discharge end and disposed so that, upon insertion into one of the bolt holes in said discharge end, the liner segments can be positioned with its bolt holes aligned in registration with the bolt holes with said discharge end.

* * * * *